US005145082A

United States Patent [19]

Craft, Jr. et al.

[11] Patent Number: 5,145,082

[45] Date of Patent: Sep. 8, 1992

[54] HANDLE REINFORCEMENT MECHANISM FOR LAUNDRY BASKET

[76] Inventors: Charles W. Craft, Jr., 58 LeRue St., Apple Creek, Ohio 44606; John L. Hradisky, 851 Gayer Dr., Medina, Ohio 44256

[21] Appl. No.: 757,148

[22] Filed: Sep. 10, 1991

[51] Int. Cl.[5] ..... B65D 25/28

[52] U.S. Cl. ..... 220/755; 220/659; 220/676; 16/111 R; 16/DIG. 12; 16/DIG. 19

[58] Field of Search ..... 220/94 R, 94 A, 485, 220/643, 646, 659, 676; 16/111 R, DIG. 12, DIG. 19

[56] References Cited

U.S. PATENT DOCUMENTS

| | | |
|---|---|---|
| 2,444,558 | 12/1945 | Elliott . |
| 2,519,186 | 8/1950 | Herbert et al. . |
| 3,072,955 | 1/1963 | Mitchell . |
| 3,083,366 | 3/1963 | Franges . |
| 3,800,361 | 4/1974 | Stauffer . |
| 3,912,140 | 10/1975 | Franges . |
| 4,004,722 | 1/1977 | Olivier . |
| 4,071,063 | 1/1978 | Russell . |
| 4,262,385 | 4/1981 | Norman . |
| 4,365,725 | 12/1982 | Pfeifer . |
| 4,366,596 | 1/1983 | Hellinger et al. . |
| 4,590,640 | 5/1986 | Enersen . |
| 4,890,355 | 1/1990 | Schulten . |

OTHER PUBLICATIONS

P. 2, Laundry Baskets, Dupol-Rubbermaid GmbH, An der Trift 63, D-6072, Dreieich, Germany. Publication date 1986.

P. 15, Laundry Baskets, Tucker Housewares, 25 Tucker Drive, Leominster, Mass. 01453. Publication date 1989.

P. 3, Laundry Baskets, Ingrid Housewares, 360 N. Skokie Highway, North Chicago, Ill. 60064. Publication date Jan. 1990.

Label, Laundry Basket, Mobil Chemical Company, Consumer Products Division, Pittsford, N.Y. 14534. Publication date 1989.

P. 18, Laundry baskets, Sterilite Corporation, P.O. Box 524, Main Street, Townsend, Mass. Publication date 1980.

P. 16, Laundry baskets, Curver, Takkebijsters 75, Postbus 6810, 4802 HV Breda, The Netherlands. Publication date 1990.

P. 15, Laundry Basket, Rubbermaid Incorporated, 1147 Akron Road, Wooster, Ohio 44691. Publication date 1977.

P. 23, Laundry Baskets, Rubbermaid Canada Inc., 2562 Stanfield Road, Mississauga, Ontario, Canada L4Y 1S5. Publication data 1986.

*Primary Examiner*—Stephen Marcus
*Assistant Examiner*—Stephen Crouin

[57] ABSTRACT

A laundry basket is disclosed, comprising four sides (4) and a bottom (5) which define an internal chamber (8). A handle opening (10) is formed in at least one of the sidewalls, proximate an upper rim (6). A handle body (12) spans the opening (10), along the rim (6). A gripping member (14) attaches to an underside of the handle body by overlapping flanges (18, 28). The gripping member (14) is upwardly concave, of relatively larger radius of curvature than the downwardly concave handle body (12). Together, the gripping member and handle body comprise a cylindrical handle assembly. The gripping member (14) is formed to provide spaced apart gripping ribs (26). Gripping ribs (26) are co-extruded with the gripping member (14), but are formed of relatively softer plastic material. Reinforcement walls (22) extend downward from the handle body (12) into the gripping member (14) and abut thereagainst for reinforcement.

15 Claims, 6 Drawing Sheets

HANDLE REINFORCEMENT MECHANISM FOR LAUNDRY BASKET

BACKGROUND OF THE INVENTION

1. Field of the Invention

This invention relates generally to molded plastic laundry baskets, or similar types of containers, and more specifically to handle reinforcement mechanisms for use in conjunction with such laundry baskets.

2. The Prior Art

Molded plastic laundry baskets are common household articles. Typically, such baskets are four sided containers, which have integral handles formed in opposite two sidewalls. The handles are formed in the sidewalls along the upper rim, and a hand opening is positioned therebeneath to facilitate manual lifting of the basket by the handles.

While such baskets are common, and have been widely accepted, certain shortcomings in the basket, and in particular the handles, make the baskets less than satisfactory. First, to conserve material cost, the rim of the basket from which the handle is formed is relatively small in cross-section. Thus, the handles are relatively small, making it uncomfortable to lift the basket thereby. Secondly, the stress load of the basket is concentrated at the handles during lifting, and the small sectional dimension of the handles makes them relatively weak and prone to breakage. Lastly, the material from which conventional baskets are molded is relatively hard polypropylene. The handles, formed integrally with the basket, are thus relatively hard, and can be uncomfortable in use to the user.

One approach to solving the above shortcomings has been to reinforce the handles by means of a secondary handle mechanism. One such device, available to the market, consists of two semi-cylindrical sleeves which attach together around a basket handle to form an enlarged diameter lifting handle. The sleeves, when combined, are more comfortable to lift due to their enlarged diameter, and distribute lifting stress so as to make breakage at the handles less likely.

The above attempt to solve the industry's and consumer's needs, however, falls short. The sleeves are formed of relatively hard plastic, which, again, makes the handles less comfortable to use. Secondly, the addition of the two sleeves to the cost of the basket is considerable, which decreases its appeal. Finally, the sleeves, when attached to the basket, are relatively "loose" in feel, and difficult to assemble, further decreasing the appeal of this approach.

SUMMARY OF THE INVENTION

The present invention solves the needs of the industry by providing a laundry basket having improved, reinforced handles. The container is formed by conventional plastic molding, and provides handle bodies at opposite sides, below which hand openings extend. The handle bodies are downwardly concave in cross-section, and are integral extensions of the upper rim of the basket. The handle bodies further comprise elongate flanges extending along outer opposite sides, and downwardly directed reinforcement wall projections which extend between the handle body sides.

An elongate handle gripping member is provided for each handle body, having an upwardly concave outer surface and inwardly directed flanges for attaching over the handle body outer flanges, whereby joining the gripping member to its handle member and together therewith forming a cylindrical gripping assembly. The handle member is molded to provide spaced apart ribs extending therealong to assist the user in gripping the handle member. The gripping member is, through a co-extrusion process, formed to provide gripping ribs extending therealong to likewise assist the user. The gripping member ribs are co-extruded from a relatively softer polyvinylchloride plastic material, whereby providing the user with a softer, more comfortable "feel". The handle gripping member is cut to a length substantially the same as the handle body, and is upwardly concave in cross-section so as to receive the handle body reinforcement walls therein.

Accordingly, it is an objective to provide a laundry basket having handle reinforcement means.

A further objective is to provide a laundry basket having integrally formed handle bodies adapted to connect with gripping members and, so combined, to form an enlarged diameter handle assembly.

Still a further objective is to provide a laundry basket having handles of composite plastic construction.

Yet a further objective is to provide a laundry basket having handles which incorporate relatively soft gripping ribs.

A further objective is to provide a laundry basket having handles which are relatively large in diameter to facilitate easy gripping.

Another objective is to provide a laundry basket having hollow cylindrical handle assemblies which include internal reinforcement means.

A further objective is to provide a laundry basket having reinforced handles which are economical to produce and readily assembled.

These, and other objectives, are achieved by a preferred embodiment which is described in detail below, and which is illustrated by the accompanying drawings.

DESCRIPTION OF THE PREFERRED EMBODIMENT

Figure 1:
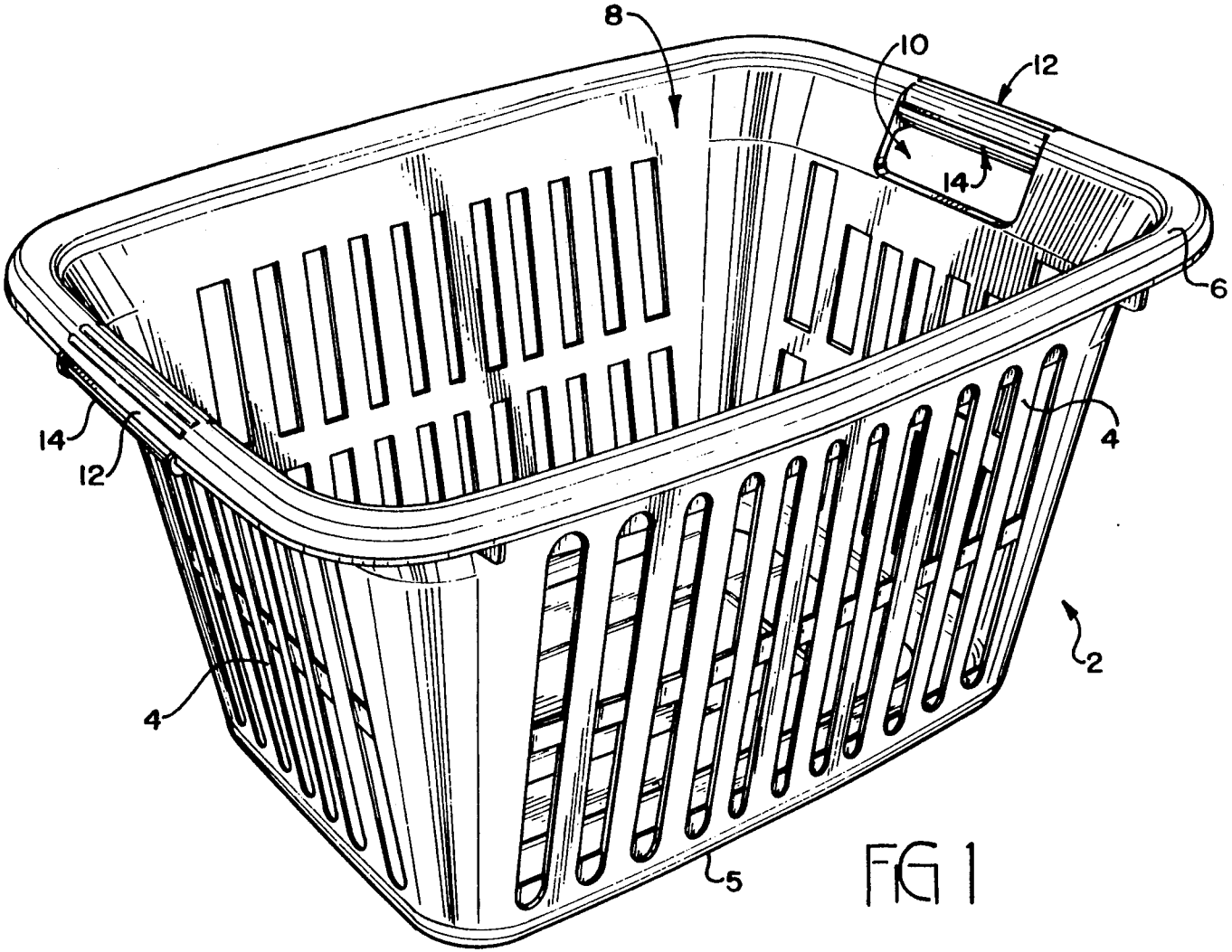
FIG. 1 is a front perspective view of a laundry basket including handle assemblies comprising the present invention.
Figure 2:
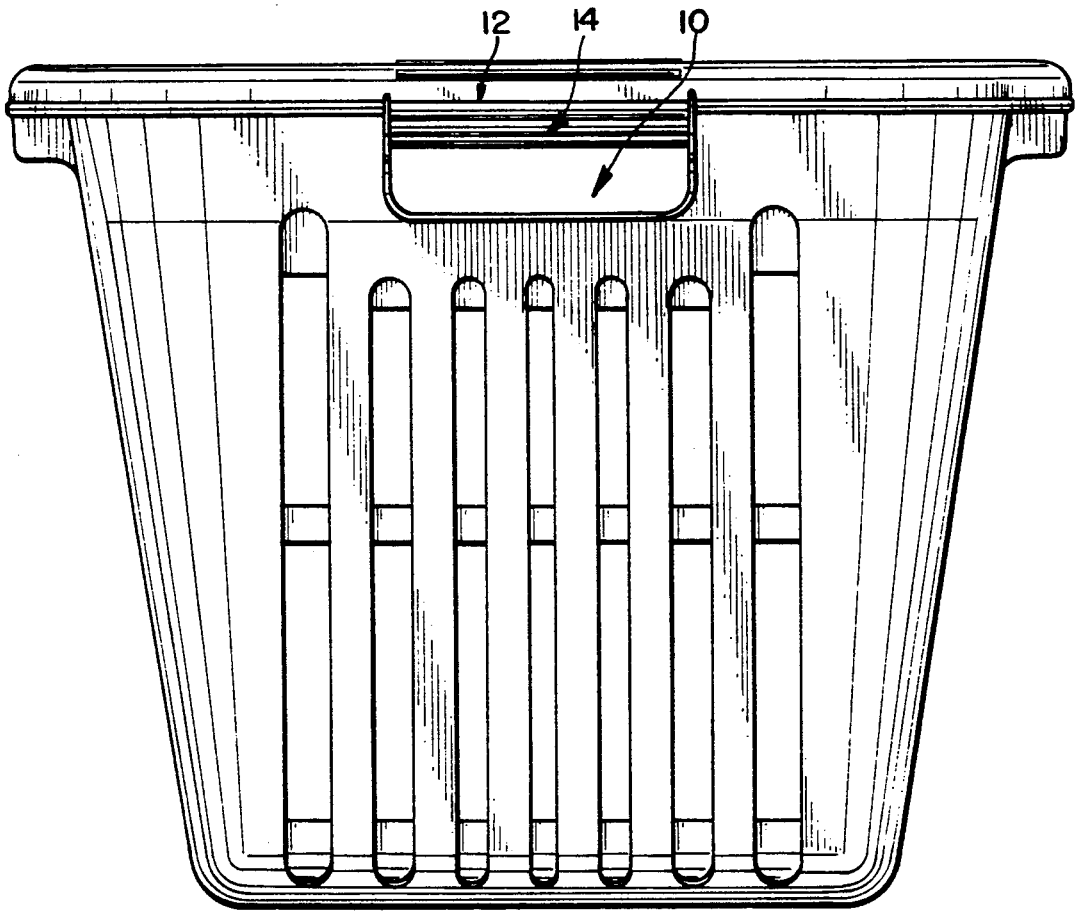
FIG. 2 is an elevational view thereof.
Figure 3:
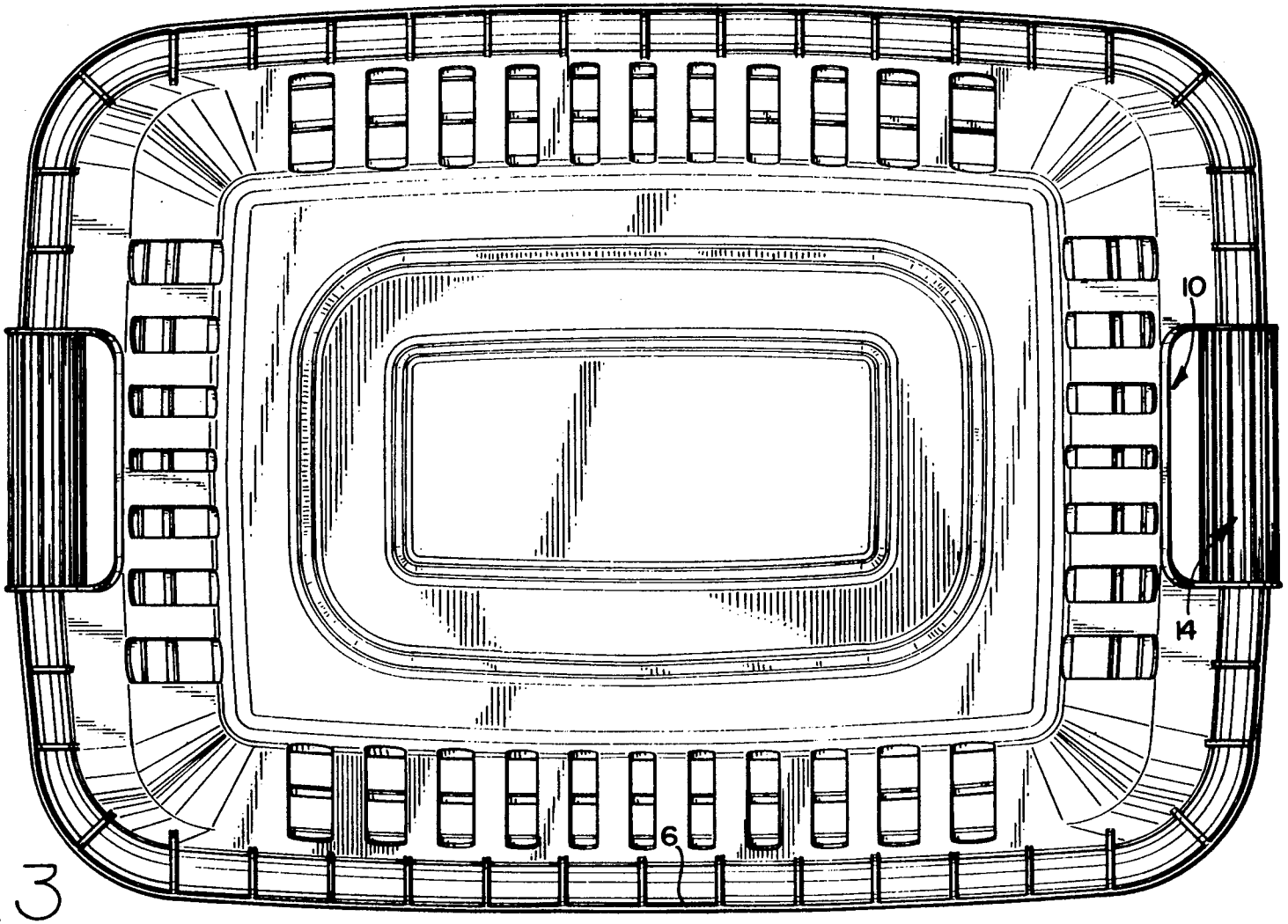
FIG. 3 is a bottom plan view thereof.

Referring first to FIGS. 1–4, it will be seen that the subject invention is applied to a container 2, preferably in the form of a laundry basket. The container 2 is defined by four sidewalls 4, which extend from a bottom floor 5 to a downturned upper rim 6. The sidewalls 4 and bottom floor 5 define an internal, top opening, chamber 8.

Positioned within the two opposite endwalls of the container 2 are handle openings 10, located proximate the upper rim 6. The container is formed, by a conventional plastic molding process of polyvinylchloride material, which is commonly available. The container 2 further comprises integral handle bodies 12 formed to bridge the hand openings 10, respectively, and extend substantially co-planar with the upper rim 6.

Provided also are two handle gripping members 14, one for each of the handle bodies 12. The handle gripping members 14 are formed separately, by an extrusion process, from polyvinylchloride plastic material, by conventional extrusion manufacturing process.

Figure 4:
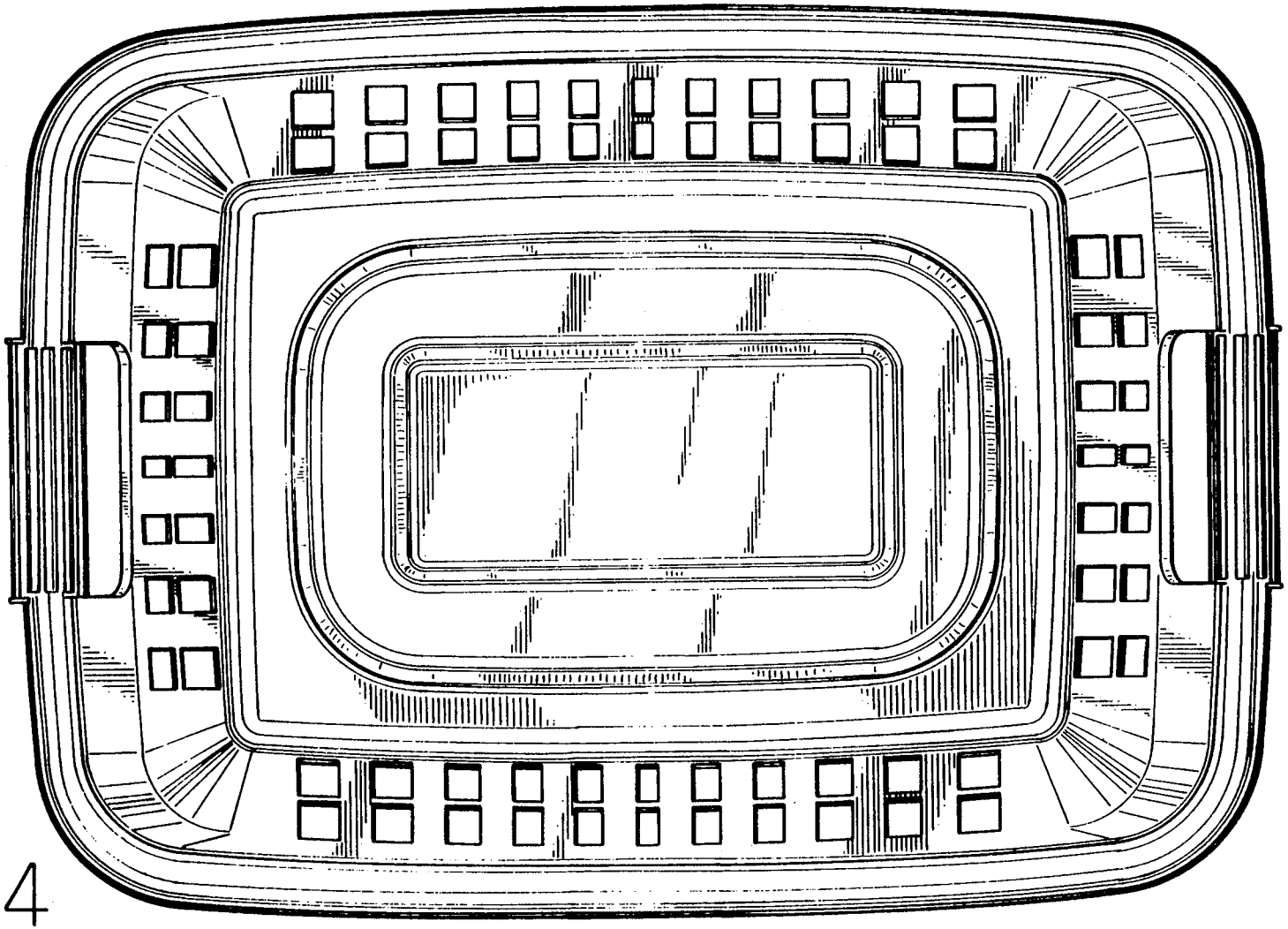
FIG. 4 is a top plan view thereof.
Figure 5:
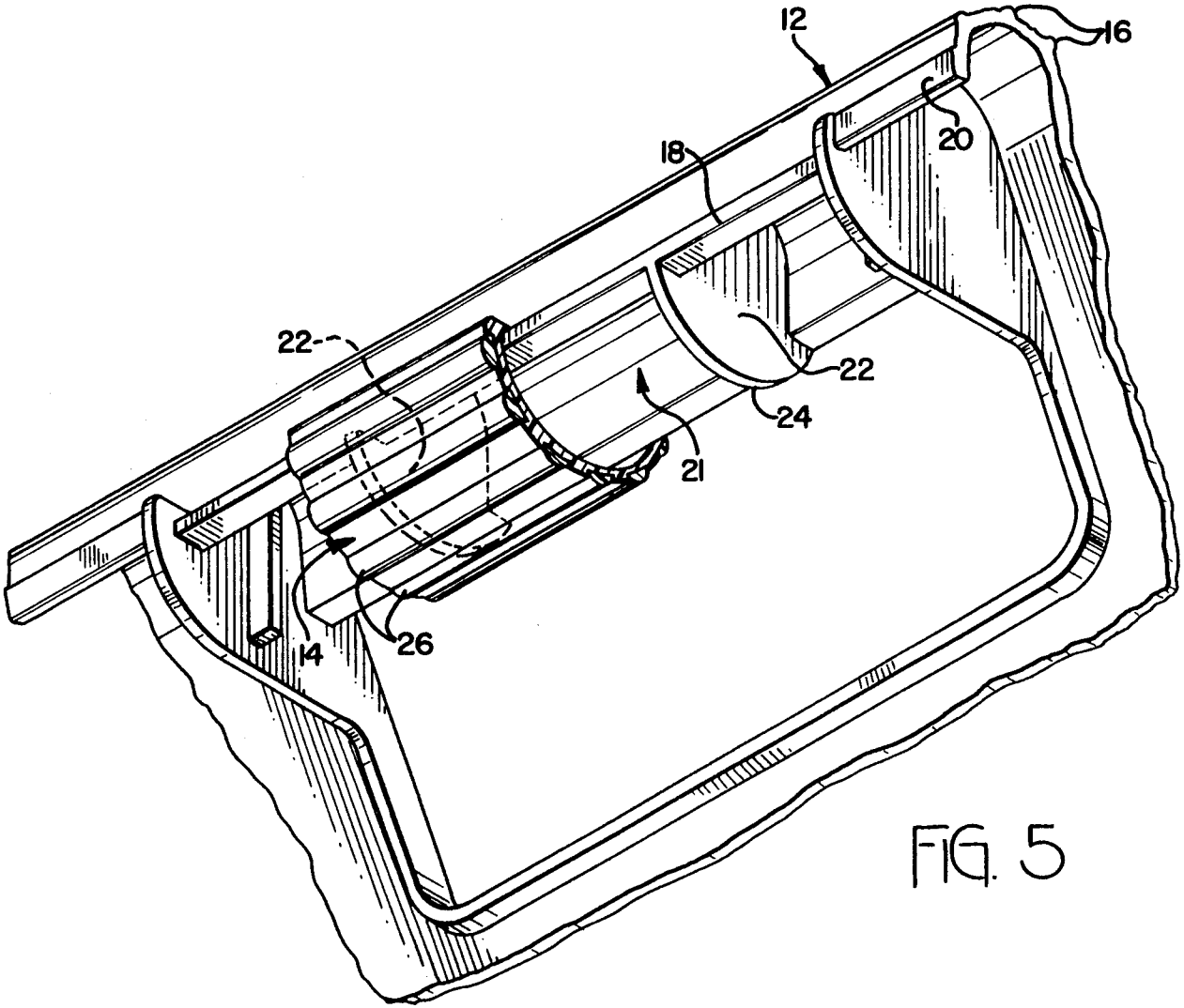
FIG. 5 is an enlarged perspective view of the handle assembly portion of the laundry basket, shown with a portion of the handle gripping member broken away for illustration.
Figure 6:
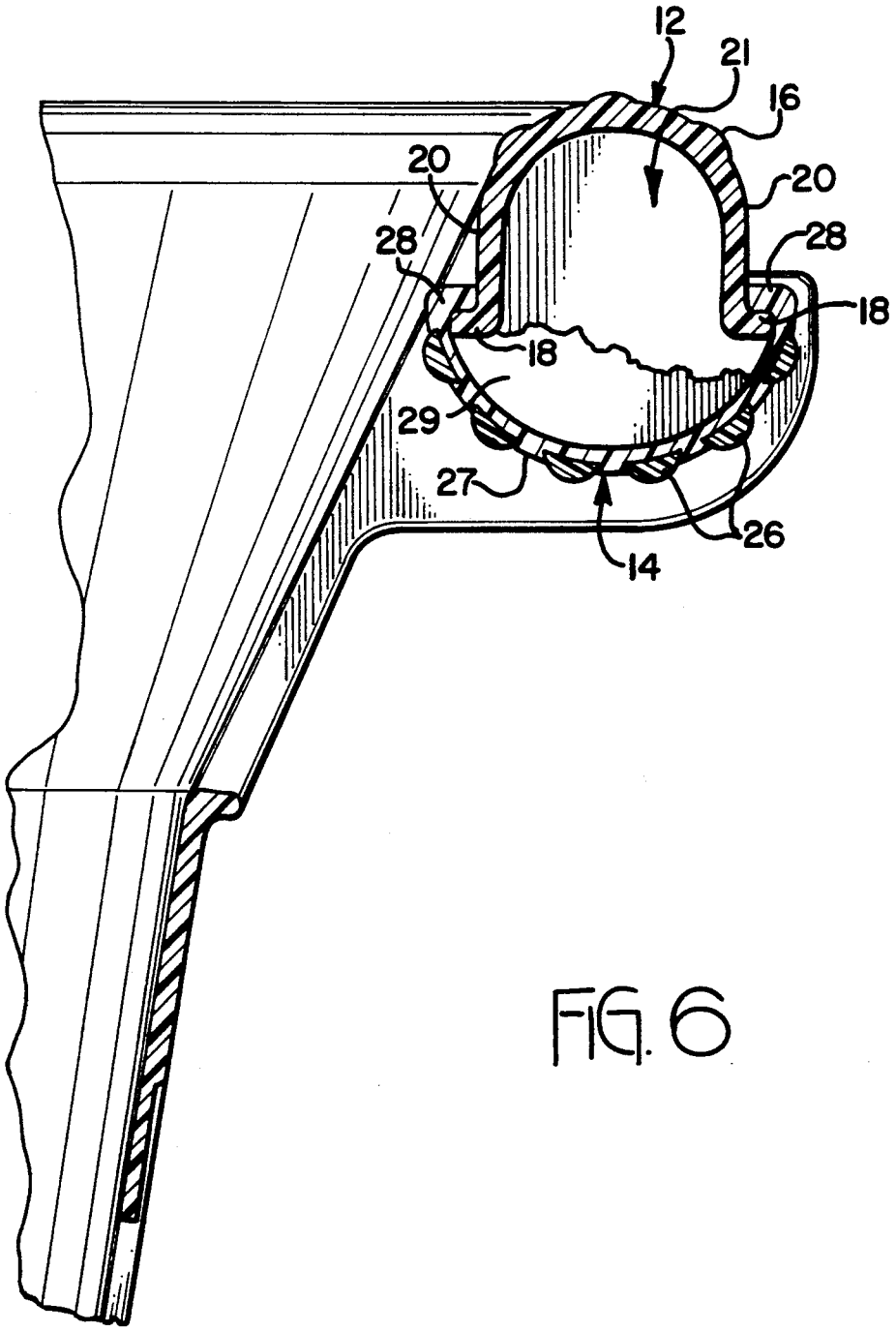
FIG. 6 is a transverse sectional view through one side of the laundry basket, illustrating the configuration of the handle assembly.

Referring next to FIGS. 4 and 5, it will be seen that the handle bodies 12 are formed having elongate longitudinal ribs 16 extending therealong. The handle bodies 12 are of downwardly concave, semi-cylindrical shape. Longitudinal flanges 18 extend along opposite sides 20 of each handle body 12, and are directed outwardly. An internal elongate channel 21 is formed by the sides 20 of the handle body 12. A pair of spaced apart, downwardly directed reinforcement walls 22 extend into and partition the channel 21. The reinforcement walls 22 are provided with an arcuate, upwardly concave, lower edge 24 for a purpose explained below.

The gripping members 14 are each formed to include co-extruded longitudinal ribs 26 spaced across an outer, semi-cylindrical surface. The gripping member 14 is generally of semi-cylindrical configuration, and has an internal elongate channel 29. Two inwardly directed flanges 28 are provided at upper edges of the gripping member surface 27.

The ribs 26 are con-extruded simultaneously with the gripping member 14, but are formed of comparatively softer polyvinylchloride plastic material. The ribs 26, so formed, have a relatively softer, more comfortable feel.

As shown by FIGS. 4 and 5, the gripping members 14 are attached to respective handle bodies 12 as the flanges 28 thereof are spread apart and then over the corresponding flanges 18 of the handle bodies 12. The hard plastic material of the gripping members 14 ensure positive attachment and retention of the gripping members 14 to the handle bodies 12.

So attached, the gripping member 14 forms with the handle body 12 a cylindrical handle assembly, by which the basket may be lifted by the user. The gripping member 14 has an outer radius of curvature which is greater than the outer radius of curvature of the handle body 12. Accordingly, the gripping member 14 provides an enlarged handle surface for the user to easily and comfortably lift the basket. The soft ribs 26 further cushion the user's grip, enhancing the appeal of the product.

The gripping member 14 is reinforced by the handle body walls 22, which project downwardly into the gripping member channel 29 and into abutment with the gripping member 14. The radius of curvature of the wall lower edges 24 complements the curvature of the gripping member 14. Consequently, the gripping member is supported and reinforced by the handle body walls 22, for strength, and to resist breakage. Yet, due to the presence of the softer ribs 26, the user's comfort is not compromised.

It will be appreciated that the present invention provides inherent advantages over the prior art. Regarding conventional laundry baskets, and their integrally molded handles, the handle assembly of the subject disclosure is stronger and is more comfortable to use (by virtue of the soft ribs 26 and the enlarged diameter of the gripping member 14). Forming the gripping member out of composite plastic construction takes advantage of the strength of hard plastic for strength consideration, yet also provides the user with a soft grip.

Regarding two-piece, handle reinforcement devices, currently on the market, the present invention likewise carries advantages. First, by utilizing the integrally molded bridging handle (handle body 12) for one half of the handle assembly, cost savings are realized. Secondly, the underside of the present handle assembly has an enlarged radius of curvature, relative to the top side of the handle assembly, which further enhances the comfort of the user. Lastly, the present assembly is tight assembled together, by the joinder of the handle body 12 to the gripping member 14. The rigid connection provides a solid handle feel, which complements the feeling of strength and structure provided by the oversized diameter of the gripping member.

While the handle assembly of the present invention is depicted in the context of a laundry basket, the invention should not be so confined. Other containers, for other uses, may find the instant teachings applicable. Accordingly, the scope of the present invention is intended to encompass such applications.

We claim:

1. A container having sidewalls and a bottom floor defining an internal chamber, said container further comprising:

a handle opening formed to extend through one said sidewall, proximate an upper rim of said sidewall;

an elongate handle body integrally formed with said one sidewall and spanning said handle opening, substantially parallel to said upper rim, said handle body having a downwardly concave outer surface and inwardly and outwardly disposed flanges extending along inward and outward sides;

an elongate handle gripping member having an upwardly concave outer surface defined by inwardly and outwardly facing sidewalls extending from a lower bight portion, said gripping member being attachable to an underside of said handle body and having inwardly extending flanges extending from said gripping member sidewalls, for engaging said handle body flanges, whereby attaching said gripping member to said handle body.

2. A container as set forth in claim 1, wherein said gripping member outer surface having a relatively larger radius of curvature than said handle body outer surface.

3. A container as set forth in claim 2, wherein said gripping member outer surface having elongate spaced apart ribs extending therealong, projecting outwardly from said gripping member outer surface.

4. A container as set forth in claim 3, wherein said gripping member outer surface being formed of relatively rigid plastic material and said gripping member ribs being formed of relatively flexible plastic material.

5. A container as set forth in claim 4, wherein said gripping member outer surface being formed of relatively rigid polyvinylchloride plastic and said gripping member ribs being formed of flexible polyvinylchloride plastic.

6. A container as set forth in claim 5, said gripping member and said ribs being integrally formed and said gripping member having a length substantially equivalent to said handle body.

7. A container as set forth in claim 6, wherein said gripping member and said handle body being of substantially U-shaped cross-sectional configuration, wherein, upon attachment, forming a substantially cylindrical surface having a relatively larger radius of curvature at the bottom than at the top.

8. A container as set forth in claim 7, wherein said handle body having internal reinforcement walls spaced therealong and extending downwardly between said handle body sides, and said reinforcement walls having at lower ends an upwardly concave end surface configured to project into said handle gripping member.

9. A container having sidewalls and a bottom floor defining an internal chamber, said container further comprising:

a handle opening extending through one said sidewall, proximate an upper rim of said sidewall;

an elongate handle body integrally formed with said one sidewall and spanning said handle opening, substantially parallel to said upper rim, said handle body having a downwardly concave outer surface and inwardly and outwardly disposed flanges extending along inward and outward sides;

an elongate handle gripping member having an upwardly concave outer surface defined by inwardly and outwardly facing sidewalls extending from a lower bight portion, said gripping member being attachable to an underside of said handle body and having inwardly directed flanges extending from said gripping member sidewalls for engaging said handle body flanges, whereby attaching said gripping member to said handle body;

said gripping member outer surface having elongate spaced apart ribs extending therealong, projecting outward from said gripping member outer surface; said gripping member outer surface being formed of relatively rigid plastic material and said gripping member ribs being formed of relatively flexible plastic material.

10. A container according to claim 9, wherein said gripping member outer surface being formed of relatively rigid polyvinylchloride plastic and said gripping member ribs being formed of flexible polyvinylchloride plastic.

11. A container according to claim 9, wherein said gripping member outer surface and said handle body outer surface forming a substantially cylindrical surface having a relatively larger radius of curvature at the bottom than at the top.

12. A container according to claim 11, wherein said gripping member outer surface and said ribs being integrally formed.

13. A container according to claim 12, wherein said gripping member having a length substantially equivalent to said handle body.

14. A container according claim 13, wherein said handle body and said gripping member being of a substantially U-shaped cross-sectional configuration.

15. A container according to claim 14, wherein said handle body having internal reinforcement walls spaced therealong and extending downwardly between said handle body sides, and said reinforcement walls having at lower ends an upwardly concave end surface configured to project into said handle gripping member.

* * * * *